United States Patent [19]

Eitel et al.

[11] 4,127,407

[45] Nov. 28, 1978

[54] METHOD OF MAKING A CASTING POWDER

[76] Inventors: Hans J. Eitel, Lönsweg 58; Jens Eitel, Prinzenhöhe 6, both of Mülheim, Germany, 4330

[21] Appl. No.: 785,179

[22] Filed: Apr. 6, 1977

[30] Foreign Application Priority Data

Apr. 7, 1976 [DE] Fed. Rep. of Germany ..... 2614957

[51] Int. Cl.[2] ..... C21C 7/00

[52] U.S. Cl. ..... 75/53; 75/57; 75/93 G

[58] Field of Search ..... 75/53, 57, 936

[56] References Cited

U.S. PATENT DOCUMENTS

| | | | |
|---|---|---|---|
| 3,301,663 | 1/1967 | Wicher | 75/57 |
| 3,309,196 | 3/1967 | Kaneko | 148/26 |
| 3,320,052 | 5/1967 | Bowden | 75/53 |
| 3,681,050 | 8/1972 | Ueki | 75/53 |
| 3,681,051 | 8/1972 | Takashima | 75/53 |
| 3,746,620 | 7/1973 | Vance | 148/26 |
| 3,760,140 | 6/1973 | Kretschmer | 148/26 |
| 3,826,695 | 7/1974 | Leicher | 148/26 |

*Primary Examiner*—Peter D. Rosenberg
*Attorney, Agent, or Firm*—Karl F. Ross

[57] ABSTRACT

A casting powder which consists of lime, alumina and silicates (or silica), with or without alkali-metal compounds serving as fluxing agents, is made by expanding the particles from a particle size of less than 40 microns to a particle size in excess of 60 microns so that the particles are generally in the form of hollow bodies. The casting particles thus have a highly insulating character and are above the dust limit so as to reduce their environmental hazard.

4 Claims, No Drawings

METHOD OF MAKING A CASTING POWDER

FIELD OF THE INVENTION

The present invention relates to a casting powder, especially for steel casting and, more particularly, to an improved casting powder which is free from certain disadvantages or earlier casting powders containing, for example, lime, alumina and silicates (or silica).

BACKGROUND OF THE INVENTION

In U.S. Pat. No. 3,969,159 and elsewhere, casting powders are described which contain, as a principal component, lime-alumina-silicates and which can contain fluxing agents such as alkali-metal compounds, e.g. alkali-metal carbonates. The casting powders of the prior art may also have, as a casting powder component, bituminous coal flyash.

Such casting powders are generally applied to the surface of a steel melt prior to or concurrently with casting in ingot molds or continuous casting molds so as to form an insulating layer between the melt and the mold, to improve the surface characteristics of the cast body, and to protect the mold from erosion by the molten metal.

A casting powder, for such purposes, must have two principal characteristics. Firstly, the casting powder must be readily melted at the interface or boundary layer between the molten casting material, i.e. the liquid steel, and the powder. This permits the casting-powder components to form a continuous film upon the molten metal. Secondly, the casting-powder layer itself must have high insulating effect, i.e. must be capable of restricting heat transfer by conduction.

In conventional casting powders, these characteristics are obtained by providing the casting powder in extremely fine-grain form, i.e. in particle sizes substantially lower than 60 microns. This, however, has created a major problem since particle sizes below this threshold, i.e. below the dust limit, are readily entrained into the atmosphere and produce substantial environmental-contamination hazards. They are detrimental to the health of the personnel of metallurgical plants in which they are used.

Prior attempts to eliminate the problem have proved to be unavailing since any increase in the particle size of conventional casting powders reduces the ability of the powder to melt at the interface and form a film or limits the thermal insulating properties.

OBJECTS OF THE INVENTION

It is the principal object of the present invention to provide a casting powder which affords rapid melting at the interface between the casting powder and the molten metal, on the one hand, and provides a high degree of thermal insulation on the molten metal surface on the other hand, without giving rise to the dust hazard mentioned above.

Another object of this invention is to provide a method of making an improved casting powder with the properties described.

It is also an object of this invention to provide an improved casting powder and method of making same whereby the disadvantages of earlier systems can be avoided.

DESCRIPTION OF THE INVENTION

These objects and others which will become apparent hereinafter are attained, in accordance with the present invention, with a casting powder of the composition described above, i.e. consisting of lime-alumina-silicates with or without bituminous coal flyash and preferably containing a fluxing agent such as sodium carbonate or potassium carbonate or both, the casting powder being in the form of hollow bodies of a practical size in excess of 60 microns, i.e. above the dust limit.

Preferably, the casting powder is in the form of closed generally spherical hollow bodies.

Surprisingly, while the particle size of the casting powder of the present invention lies above 60 microns, i.e. the particle size of the particles is such that dust formation does not occur in use, the particles retain their ability to melt rapidly at the interface between the particle layer and the molten metal and have insulating characteristics which are equal to or exceed those of the solid (nonhollow) particles hitherto used as casting powder. In other words, the interface between the casting powder of the present invention and the molten steel, the casting powder rapidly fuses or melts. Furthermore, the casting powder layer provides an excellent barrier to heat conduction which appears to be related to the low specific gravity of the powder according to the invention.

It has been found that when the hollow bodies constituting the particles of the casting powder are generally spherical, the casting powder is highly fluid so that it flows practically automatically uniformly onto the surface of the molten metal and thereby automatically ensures an effective distribution of the powder upon this surface. As a result it is not necessary to provide special means for effecting a uniform distribution of the powder onto the surface.

According to the invention, moreover, the individual hollow bodies forming the particles of the casting powder contain, in finely divided form, one or more carbon carriers, e.g. carbon black or soot. The latter can be provided in a particle size which is preferably smaller than 20 microns. The presence of the carbon in the particles increases the surface tension so that the melting rate of the casting powder is reduced. This has the advantage that, while the casting powder melts in contact with the molten material, the particles not in direct contact, i.e. those which are somewhat spaced from the interface, remain intact to form a thermal insulating layer. Such particles melt less rapidly and hence provide an increased thermally insulating layer for a longer period.

The present invention also comprehends a process for producing the aforedescribed casting powders from a fine-grain starting material with a particle size which is preferably less than 40 microns and, more advantageously, less than 20 microns. According to the invention, a casting-powder material of the aforedescribed composition is suspended in a liquid preferably containing an expanding agent which can interact with the particles to induce the expansion thereof during the expansion step. The expanding agent can be a substance having a relatively high vapor pressure so that it acts substantially exclusively by transformation from the liquid state to the vapor state upon softening of the particles in the suspending medium. It can be a substance which chemically reacts with the components of the casting powder to generate gas which causes the particles to expand or it can be substantially any other conventional expanding agent used for the expansion of perlite, minerals generally and glasses.

According to the invention, the mixture of the particles of the starting material and the expanding agent is then subjected to an expansion step by atomizing or spraying this mixture.

When the method of the present invention is carried out as described above, the casting powder is obtained in a form in which the particles are substantially identical, i.e. the powder is practically homogeneous, which ensures a uniform melting of the casting powder upon the surface of a steel melt.

EXAMPLE

16% by weight aluminum oxide, 16% by weight lime, 24.9% by weight silicon dioxide, 20.9% by weight sodium carbonate and 22.2% by weight potassium carbonate are heated together to form a molten mass which is then cooled. The fused mass is finely ground and grated to a particle size of 15 microns. The particles are suspended in water with agitation for a period of 30 minutes. Thereafter, a slurry of the particles and water is sprayed from an atomizing nozzle into a chamber evacuated to a pressure of 15 torr to flash evaporated water. The particles are examined and found to be expanded to a particle size of about 65 microns and to have a ball configuration. After the particles are dried, they are applied to a steel mill in comparative tests with particles of 15 micron particle size used as the starting material. The 15 micron particles generated substantial dust and were practically ineffective because of the difficulty in distributing the powder onto the melt. The 65 micron particles, which were hollow, flowed readily onto the surface of the melt without any noticeable dust formation and served as an effective casting powder layer. The process was repeated adding 10% by weight of carbon black of a particle size below 5 microns to 90% by weight of the casting powder composition made as described above. Similar results were obtained. Alcohols, namely methyl alcohol, a mixture of 50% methyl alcohol and 50% methyl ethyl ketone, a mixture of petroleum hydrocarbons, and Freon-type fluorochlorohydrocarbons were also found to be effective as expanding agents. When the hydrophobic organic expanding agents were used, it was found to be advantageous to include water which appeared to be useful in the agitated suspension to promote penetration of the particles by the solvent.

We claim:

1. A method of making a casting powder which comprises the steps of:

forming particles of a particle size below 40 microns of at least one casting powder component selected from the group consisting of bituminous coal fly ash, lime alumina and silica;

forming a slurry of said particles in water and mixing same with an expanding agent to form a mixture; and expanding said mixture by spraying it into an evacuated chamber to transform said particles into hollow bodies of a particle size in excess of 60 microns.

2. The method defined in claim 1 wherein the particles mixed with said expanding agent have a particle size below 20 microns.

3. The method defined in claim 2 wherein the particles mixed with said expanding agent, further contain a carbon carrier in a particle size below 20 microns.

4. The method defined in claim 1 wherein said particles are formed of a lime-alumina-silicate composition or bituminous coal fly ash and include an alkali-metal fluxing compound selected from the group which consists of potassium carbonate and sodium carbonate.

* * * * *